US010053316B2

(12) United States Patent
Kawase et al.

(10) Patent No.: US 10,053,316 B2
(45) Date of Patent: Aug. 21, 2018

(54) PAPER SHEET SEPARATING DEVICE AND PAPER SHEET SEPARATING METHOD

(71) Applicant: FUJITSU FRONTECH LIMITED, Inagi (JP)

(72) Inventors: Kazuhiko Kawase, Inagi (JP); Atsushi Ando, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 0 days.

(21) Appl. No.: 15/651,610

(22) Filed: Jul. 17, 2017

(65) Prior Publication Data

US 2017/0313532 A1 Nov. 2, 2017

Related U.S. Application Data

(63) Continuation of application No. PCT/JP2015/058367, filed on Mar. 19, 2015.

(51) Int. Cl.

| | |
|---|---|
| ***B65H 3/52*** | (2006.01) |
| ***B65H 5/06*** | (2006.01) |
| ***B65H 3/06*** | (2006.01) |
| ***B65H 7/02*** | (2006.01) |
| ***G07D 11/00*** | (2006.01) |

(52) U.S. Cl.

CPC ..... *B65H 3/5284* (2013.01); *B65H 3/063* (2013.01); *B65H 5/062* (2013.01); *B65H 7/02* (2013.01); *G07D 11/0024* (2013.01); *B65H 2701/1912* (2013.01); *G07D 2211/00* (2013.01)

(58) Field of Classification Search

CPC ..... B65H 3/06; B65H 3/0638; B65H 3/52; B65H 3/5207; B65H 3/5261; B65H 3/5284; B65H 2404/113; B65H 2404/1321; B65H 2404/144

See application file for complete search history.

(56) References Cited

U.S. PATENT DOCUMENTS 5,273,269 A * 12/1993 Iwanaga ..... B65H 3/5238 271/124

5,318,287 A 6/1994 Okayama

FOREIGN PATENT DOCUMENTS

| | | |
|---|---|---|
| JP | 2-110040 | 4/1990 |
| JP | 5-69962 | 3/1993 |
| JP | 9-315608 | 12/1997 |
| JP | 11-208920 | 8/1999 |
| JP | 2001-199569 | 7/2001 |

(Continued)

OTHER PUBLICATIONS

International Search Report dated Jun. 23, 2015 in corresponding International Patent No. PCT/JP2015/058367.

(Continued)

*Primary Examiner* — David H Bollinger

(74) *Attorney, Agent, or Firm* — Staas & Halsey LLP

(57) ABSTRACT

In the separation roller, an entire area of a circumferential surface of the separation roller facing the sending roller is exposed to come in direct contact with the banknote, moving from the storage unit, on the storage unit side with respect to a contact portion which is in contact with the sending roller, both end portions in an axial direction of the separation roller are formed of a material having a friction coefficient smaller than that of a central portion thereof, and the diameter of the both end portions is the same as the diameter of the central portion.

4 Claims, 13 Drawing Sheets

(56) References Cited

FOREIGN PATENT DOCUMENTS

| | | |
|---|---|---|
| JP | 2002-19985 | 1/2002 |
| JP | 2013-28424 | 2/2013 |
| JP | 2014-47073 | 3/2014 |

OTHER PUBLICATIONS

Written Opinion of International Search Authority dated Jun. 23, 2015 in corresponding International Patent No. PCT/JP2015/058367.

Notification of Reasons for Refusal, dated Oct. 3, 2017, in Japanese Application No. 2017506001 (5 pp.).

* cited by examiner

PAPER SHEET SEPARATING DEVICE AND PAPER SHEET SEPARATING METHOD

CROSS-REFERENCE TO RELATED APPLICATION

This application is a continuation application of International Application PCT/JP2015/058367, filed on Mar. 19, 2015 and designating the U.S., the entire contents of which are incorporated herein by reference.

FIELD

The present invention relates to a paper sheet separating device and a paper sheet separating method.

BACKGROUND

A banknote handling device such as an automated teller machine (ATM) includes a banknote storing device that temporarily stores input banknotes. Such a banknote storing device includes a banknote separating device that separates and sends out stacked banknotes sheet by sheet after the banknotes are stored.

FIG. 12 is a schematic diagram illustrating an operation of conveying banknotes using a separation roller and a sending roller in a conventional banknote separating device. As illustrated in FIG. 12, a conventional banknote separating device 111 includes a set of separation roller 116 and sending roller 117 that are used to separate and send out banknotes 102 stacked in a storage unit 114 sheet by sheet. In the banknote separating device 111, banknotes 102 are sent along a conveyance passage 114*b* from a sending port 114*a* of the storage unit 114. At this time, the plural banknotes 102, sent from the sending port 114*a* to the separation roller 116, are sent in a state in which the banknotes are shifted in positions and overlapped in a step shape in a direction in which the banknotes approach the separation roller 116. In the banknote separating device 111, when the plural banknotes 102 stacked in the storage unit 114 are separated sheet by sheet, a leading edge of the banknote 102, moving to the separation roller 116, comes in contact with a circumferential surface of the separation roller 116. The leading edge of the banknote 102 is sent to a contact portion 120, in which the separation roller 116 and the sending roller 117 contact each other, by a frictional force between the overlapped banknotes 102 after coming in contact with the circumferential surface of the separation roller 116. By causing the sending roller 117 to rotate relative to stationary separation roller 116, the banknote 102, sent to the contact portion 120, is conveyed through the contact portion 120 and is set to the outside of the banknote separating device 111.

As a roller which is used to convey banknotes, a configuration in which a rubber ring is attached to a ring groove formed on the circumferential surface of a reference roller formed of metal is known. The reference roller having this configuration is used to convey a banknote, which is interposed between a detection roller and the reference roller, in a thickness detecting unit that detects a thickness of the banknote.

Patent Literature 1: Japanese Laid-open Patent Publication No. 2014-47073

The entire circumferential surface of the separation roller 116, which is used in the conventional banknote separating device 111, is formed of a rubber material and a high friction coefficient is secured in the entire circumferential surface to prevent plural banknotes 102 from being overlapped and conveyed to the contact portion 120 with the sending roller 117. The width in the axial direction A (see FIG. 15) of the separation roller 116 is larger than the width of the sending roller 117. Accordingly, in the contact portion 120, the circumferential surface of the sending roller 117 comes in contact with a central portion in the axial direction (the width direction) A of the circumferential surface of the separation roller 116.

In general, in the banknote separating device 111, since the leading edges of banknotes 102, moving from the storage unit 114, come into contact with the circumferential surface of the separation roller 116 at a contact point P1 in the vicinity of the contact portion 120, the overlap of the banknotes 102 is suppressed, the leading edge of one banknote 102 is guided to a contact point P0 of the contact portion 120, and the banknote 102 is appropriately sent out. However, the sending port 114*a* of the storage unit 114 is formed to be larger than the thickness of the banknote 102 and the length thereof in the long-side direction to smoothly send the banknote 102 from the inside of the storage unit 114. Accordingly, in the banknote separating device 111, the leading edge of the banknote 102, moving from the storage unit 114, may come in contact with the circumferential surface of the separation roller 116 at a contact point P2 separated to the storage unit 114 side from the vicinity of the contact portion 120 as illustrated in FIG. 12. In this case, since the separation roller 116 is formed of rubber, the frictional force between the banknote 102 and the circumferential surface of the separation roller 116 may act greatly on the leading edge of the banknote 102 to stop movement of the banknote 102. As a result, there is a problem in that the banknote 102 is guided in an abnormal state to between the separation roller 116 and the sending roller 117 to cause a paper jam (hereinafter, referred to as a jam).

In addition, in the conventional banknote separating device 111, when the leading edge of the banknote 102 comes in contact with an edge on the end face sides of both end portions in the axial direction A of the separation roller 116, the banknote 102 may stop by the frictional force with the edge or skewing, in which the banknote 102 is obliquely send in the appropriate sending direction of the banknote 102, may occur. As a result, there is a problem in that the skewing banknote 102 is guided between the separation roller 116 and the sending roller 117 to cause a jam.

As a countermeasure against this problem, a configuration using a roller cover that guides movement of the leading edge of a banknote 102, has been proposed. FIGS. 13 and 14 are a perspective view and a cross-sectional view illustrating a metal plate of a roller cover which is disposed in a banknote separating device according to a related art. FIG. 15 is a perspective view illustrating a separation roller and a metal plate which are disposed in the banknote separating device according to the related art.

As illustrated in FIGS. 13 and 14, a banknote separating device 211 according to the related art includes a roller cover 131 that guides the leading edge of a banknote 102, moving from the storage unit 114 to the contact portion 120. The roller cover 131 includes a guide portion 132 formed of a resin and a metal plate 133 which is supported by the guide portion 132. The roller cover 131 is disposed adjacent to the storage unit 114 to cover the separation roller 116. The guide portion 132 extends from the inside of the storage unit 114 to the vicinity of the separation roller 116 and includes a curved surface 132*a* which is curved along the circumferential surface of the separation roller 116. A banknote 102, stacked in the storage unit 114, is guided to the vicinity of the separation roller 116 along the curved surface 132*a* of the guide portion 132. As illustrated in FIGS. 14 and 15, the metal plate 133 is disposed to be curved along the circumferential surface of the separation roller 116. The metal plate 133 covers a range from an end portion on the storage unit 114 side to the vicinity of the contact portion 120 on the circumferential surface of the separation roller 116. Accordingly, the metal plate 133 prevents the leading edge of a banknote 102 from coming in contact with the circumferential surface of the separation roller 116 at a position closer to the storage unit 114 side.

FIG. 16 is a schematic diagram illustrating an operation of conveying a banknote 102 using the separation roller 116 and the sending roller 117 in the banknote separating device 211 according to the related art. As illustrated in FIG. 16, the leading edge of a banknote 102, moving to the circumferential surface of the separation roller 116, slides over the outer surface of the metal plate 133 in the range from the storage unit 114 side to the vicinity of the contact portion 120, and the leading edge of the banknote 102 is guided to the contact portion 120 along the circumferential direction of the separation roller. Even when the leading edge of the banknote 102 moves to the circumferential surface of the separation roller 116 at the contact point P2 closer to the storage unit 114, the leading edge of the banknote 102 slides over the metal plate 133 and is guided to the contact point P1 and thus is smoothly guided to the contact point P0 of the contact portion 120. Accordingly, the metal plate 133 of the roller cover 131 assists appropriate separation of the banknotes 102. In this way, the metal plate 133 prevents the banknote 102 from being stopped by locking the leading edge of the banknote 102 to the circumferential surface of the separation roller 116 by the frictional force between the leading edge of the banknote 102 and the circumferential surface of the separation roller 116 to interfere with movement of the banknote 102.

The metal plate 133, which is used in the banknote separating device 211 according to the above-mentioned related art, has a thickness of about 0.2 mm and is curved in a desired arc shape along the circumferential surface of the separation roller 116. It is thought that such a metal plate 133 is molded using a resin material, but in molding of a resin material, it is difficult to form the resin material with the same small thickness as the metal plate 133 and to form the resin material in a shape in which a tip thereof is sharp like the end portion of the metal plate 133. In order to cause the metal plate 133 to maintain such predetermined rigidity not to be bent by collision with a banknote 102, both sides of the metal plate 133 in the axial direction of the separation roller 116 are fixed to the guide portion 132. Accordingly, the banknote separating device 211, using the metal plate 133, causes an increase in manufacturing cost by forming the metal plate 133 in a desired arc shape and attaching the metal plate to the guide portion 132.

From the viewpoint of satisfactorily preventing skewing or jam at the time of separation of a banknote 102, it is preferable that an area from the storage unit 114 side to the vicinity of the contact portion 120 on the circumferential surface of the separation roller 116 be covered with the metal plate 133. On the other hand, in the banknote separating device 211, when a jam occurs, a banknote 102 is removed from between the separation roller 116 and the sending roller 117 by reversely conveying the banknote 102 in the direction opposite to the input direction of the banknote 102. Accordingly, when the range, in which the circumferential surface of the separation roller 116 is covered with the metal plate 133, is extended to the vicinity of the contact portion 120, the trailing edge of the banknote 102 is easily locked to the metal plate 133 at the time of reversely conveying the banknote 102. As a result, the metal plate 133 is easily turned by the reversely conveyed banknote 102 and it is difficult to smoothly remove the locked banknote 102. Accordingly, an adjustment operation of positioning the metal plate 133 at a predetermined position in the circumferential direction of the separation roller 116, that is, an operation of appropriately adjusting a range in which the circumferential surface of the separation roller 116 is covered with the metal plate 133, in consideration of this influence becomes troublesome, thereby causing an additional increase in manufacturing cost.

In addition, in order to prevent a banknote 102 from being stopped when the leading edge of the banknote 102 comes in contact with the edge of the separation roller 116, a countermeasure of performing a chamfering process (an R chamfering process) of rounding the edges on both end face sides of the separation roller 116 in an arc shape, has been employed. However, the R chamfering process of the edges on both end face sides is performed for each separation roller 116 and thus the processing cost also increases.

As described above, in the banknote separating device 211 according to the related art, it is possible to prevent skewing of banknotes 102 or a jam of banknotes 102, by forming a part of the roller cover 131 out of the metal plate 133, by adjusting the position of the metal plate 133, and by performing the R chamfering process of the edges of the separation roller 116. However, this series of processes causes an increase in manufacturing cost.

When the reference roller described in Patent Literature 1 is used as the separation roller, the rubber ring, protruding from the circumferential surface of the reference roller, comes in contact with a banknote, but the circumferential surfaces on both sides of the rubber ring do not easily come in contact with the banknote well. Accordingly, with the reference roller, there remains a problem that the leading edge of a banknote is not made to slide over the circumferential surface of the reference roller and the banknote skews, and an effect of preventing a jam is not achieved. Accordingly, in the technique described in Patent Literature 1, banknotes are not appropriately separated and it is not proper to employ the reference roller as the separation roller.

SUMMARY

According to an aspect of the embodiments, a paper separating device includes: a separation roller with which a paper sheet, stacked in a storage unit that stores paper sheets and sent from the storage unit, comes in contact; and a sending roller that is disposed in contact with the separation roller and that separates and conveys the paper sheets sheet by sheet by rotating relative to the stopped separation roller, wherein an entire area of a circumferential surface of the separation roller facing the sending roller, is exposed to come in direct contact with the paper sheet, moving from the storage unit, on the storage unit side with respect to a contact portion which is in contact with the sending roller, both end portions in an axial direction of the separation roller are formed of a material, having a friction coefficient smaller than a friction coefficient of a central portion in the axial direction of the separation roller, and the diameter of the both end portions is the same as the diameter of the central portion.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Hereinafter, embodiments of a paper sheet separating device and a paper sheet separating method which are disclosed herein will be described in detail with reference to the accompanying drawings. The paper sheet separating device and the paper sheet separating method disclosed herein are not limited by the following embodiments.

[Embodiments]

(Configuration of Banknote Handling Device)

Figure 1:
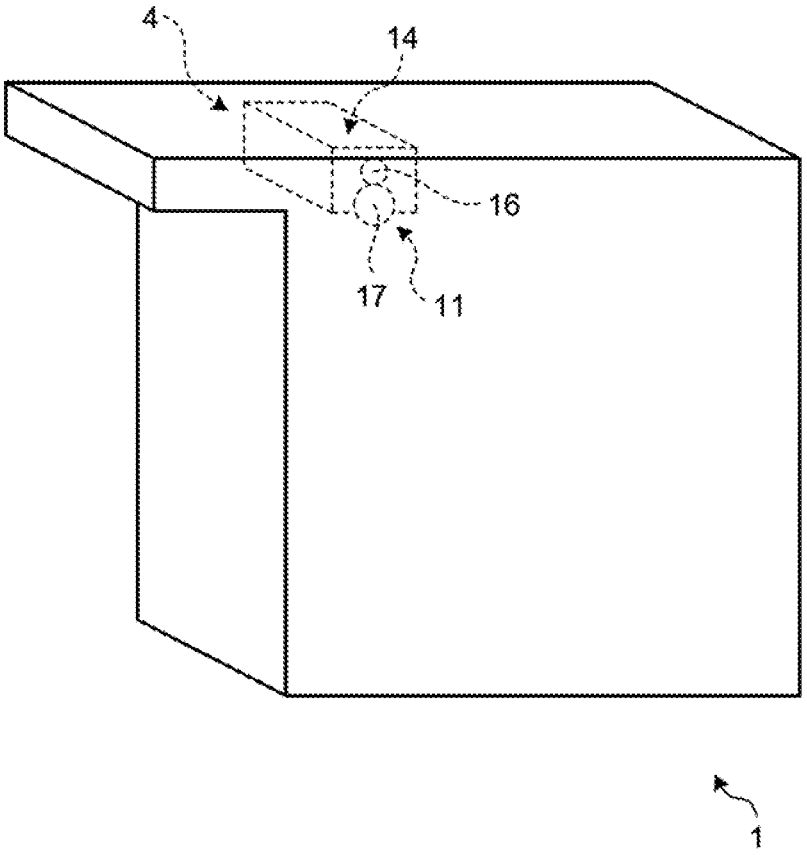
FIG. 1 is a perspective view schematically illustrating an appearance of a banknote handling device according to an embodiment.
Figure 2:
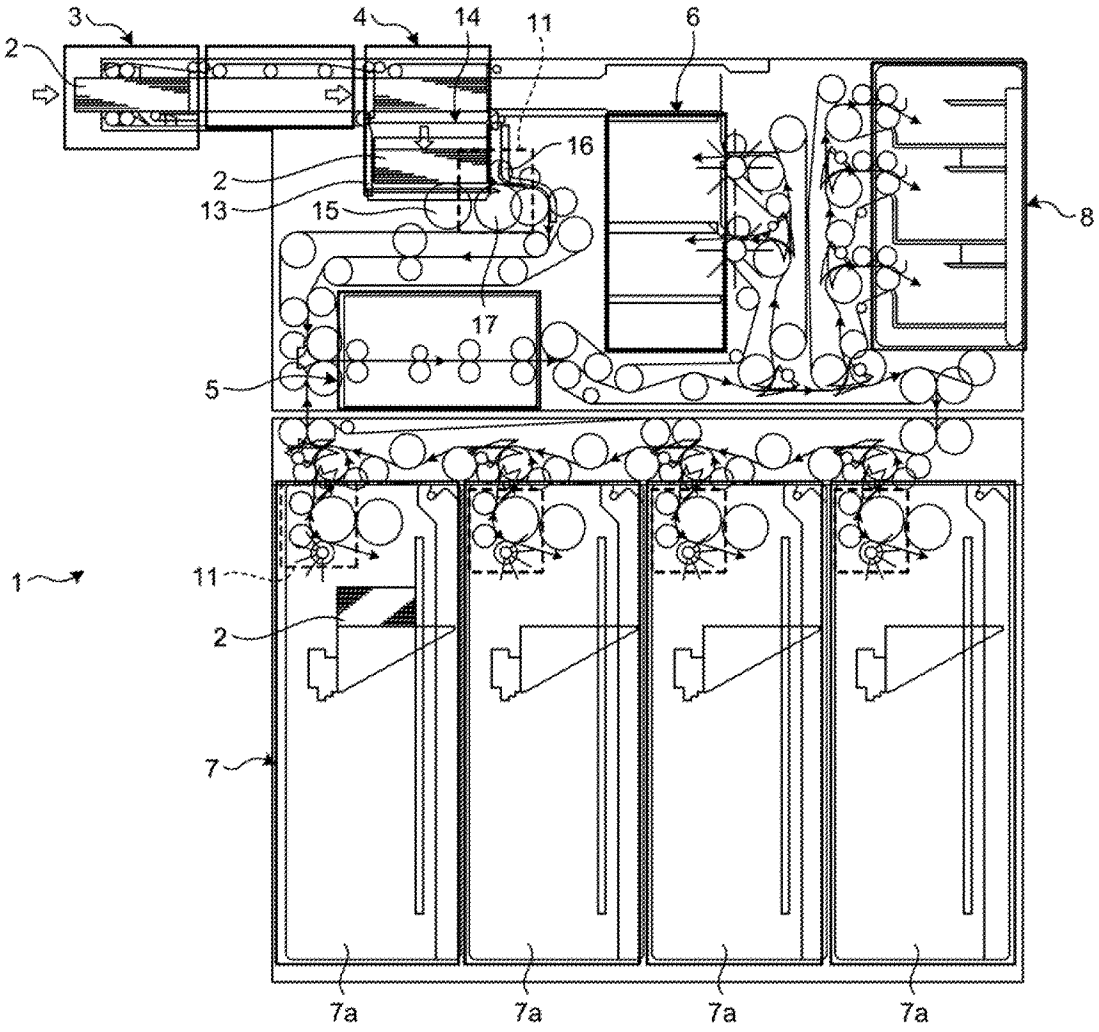
FIG. 2 is a schematic cross-sectional view illustrating the banknote handling device according to the embodiment.

FIG. 1 is a perspective view schematically illustrating an appearance of a banknote handling device according to an embodiment. FIG. 2 is a schematic cross-sectional view illustrating the banknote handling device according to the embodiment.

As illustrated in FIGS. 1 and 2, a banknote handling device 1 according to the embodiment includes an input and output unit 3 that inputs and outputs a banknote 2, a first temporary storage unit 4 that temporarily stores the banknote 2 input to the input and output unit 3, a discrimination unit 5 that discriminates the banknote 2 conveyed from the first temporary storage unit 4, and a second temporary storage unit 6 that temporarily stores the banknote 2 conveyed from the discrimination unit 5. The banknote handling device 1 includes a return unit 7 that returns a banknote 2 by storing and outputting the banknote 2 conveyed from the discrimination unit 5, and a reject unit 8 that stores a banknote 2 having an abnormal thickness or length or a degraded (damaged) banknote 2.

As illustrated in FIG. 2, in the banknote handling device 1, a banknote 2, which is input from the input and output unit 3, is stored in the first temporary storage unit 4 and then is discriminated by the discrimination unit 5. The banknote 2 discriminated by the discrimination unit 5 is stored and stacked in the second temporary storage unit 6. At this time, when the input banknote 2 is returned, the banknote 2 stored in the second temporary storage unit 6 is conveyed to the input and output unit 3 and is returned from the input and output unit 3. On the other hand, when the input banknote 2 is deposited, the banknote is conveyed from the second temporary storage unit 6 to the first temporary storage unit 4 again, is then conveyed from the first temporary storage unit 4 to the discrimination unit 5, and is then stored in a storage cassette 7*a* of the return unit 7 from the discrimination unit 5 by types of the banknote 2. Then, when banknotes 2 stored in the return unit 7 are output, the banknotes are conveyed from the return unit 7 to the discrimination unit 5 and are then conveyed and stored from the discrimination unit 5 into the second temporary storage unit 6. Subsequently, the banknotes 2 stored in the second temporary storage unit 6 are conveyed to the input and output unit 3 and are output from the input and output unit 3. The thickness and length or the degradation state of the banknotes 2 input from the input and output unit 3, is detected by the discrimination unit 5 and a banknote 2 detected to be abnormal is conveyed and stored from the discrimination unit 5 into the reject unit 8.

The first temporary storage unit 4 assembled into the banknote handling device 1 having the above-mentioned configuration, includes a banknote separating device 11 according to the embodiment as illustrated in FIG. 2. The return unit 7 of the banknote handling device 1 also includes the banknote separating device 11 according to the embodiment, similarly to the first temporary storage unit 4. In the following embodiment, the banknote separating device 11, which is included in the first temporary storage unit 4, will be described as an example. In this embodiment, a banknote 2 is used as an example of a paper sheet, but the invention is not limited to the paper sheet.

(Configuration of Banknote Separating Device)

Figure 3:
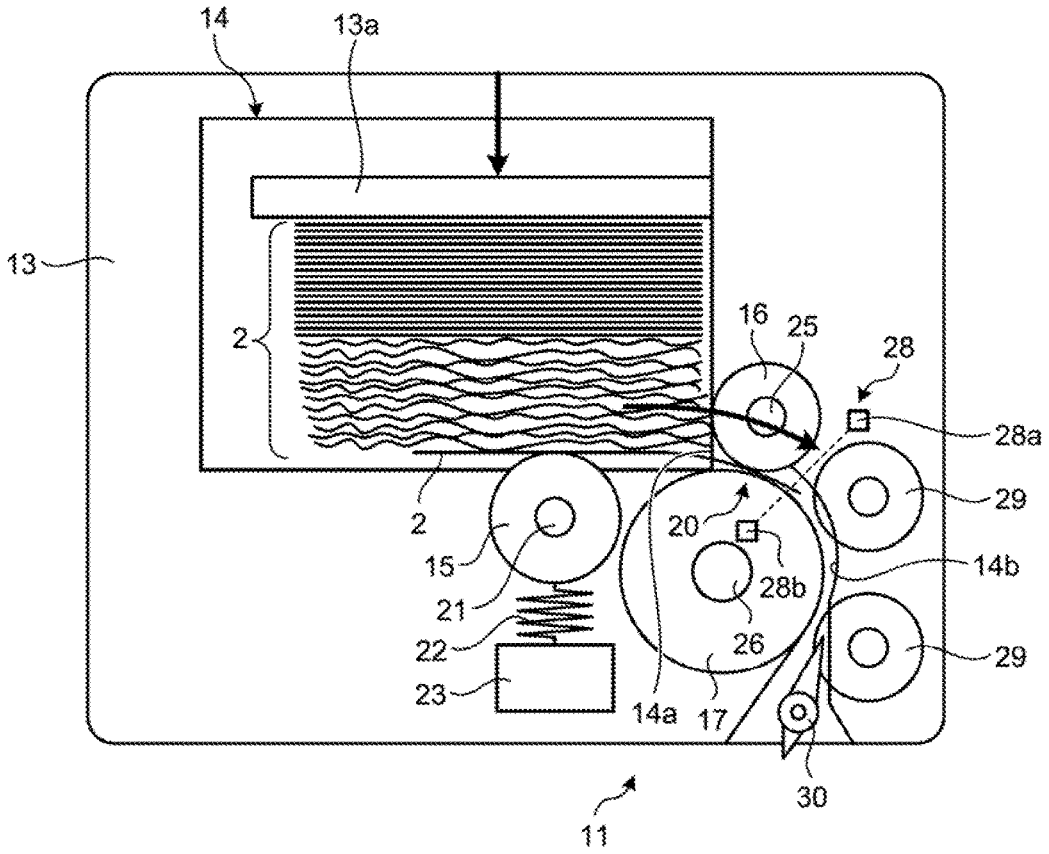
FIG. 3 is a cross-sectional view schematically illustrating a banknote separating device according to the embodiment.

FIG. 3 is a cross-sectional view schematically illustrating the banknote separating device 11 according to the embodiment. As illustrated in FIG. 3, the banknote separating device 11 according to the embodiment includes a storage cassette 13, a pickup roller 15, and a set of a separation roller 16 and a sending roller 17.

As illustrated in FIG. 3, the storage cassette 13 includes a storage unit 14 in which banknotes 2 are temporarily stored. Banknotes 2, which are carried to the banknote separating device 11, are stacked and stored in the vertical direction in the storage unit 14. The storage unit 14 is provided with a sending port 14*a* for sending out stacked banknotes 2, at a position adjacent to the separation roller 16. The sending port 14*a* is formed larger than the thickness and the length in the long-side direction of the banknotes 2 and can smoothly send out banknotes 2 from the inside of the storage unit 14. The banknotes 2 passing through the sending port 14*a*, are sent out along a conveyance passage 14*b*.

The storage cassette 13 includes a stage 13*a* that presses plural banknotes 2 stacked in the storage unit 14 in the thickness direction. The stage 13*a* is disposed to be movable in the vertical direction in the storage unit 14. The stage 13*a* is biased to the bottom side on which the pickup roller 15 is disposed in the thickness direction of the stacked plural banknotes 2, by a pressing force of a pressing mechanism which is not illustrated.

The pickup roller 15 is disposed adjacent to the bottom of the storage unit 14 and is supported by a rotation shaft 21. A lowermost banknote 2 (an input-side banknote 2) among the plural banknotes 2 stacked in the storage unit 14, comes in contact with the circumferential surface of the pickup roller 15. The pickup roller 15 is rotated by a driving mechanism, which is not illustrated, to convey the lowermost banknote 2 in the storage unit 14 to a contact portion 20 in which the separation roller 16 and the sending roller 17 contact each other. As illustrated in FIG. 3, the pickup roller 15 is supported by a coil spring 22 to be movable in the thickness direction of the plural banknotes 2 stacked in the storage unit 14, that is, in the moving direction of the stage 13*a*.

The coil spring 22 is provided with a pressure sensor 23 that senses the pressing force applied to the pickup roller 15. The pressing mechanism that presses the stage 13*a* is controlled by a control unit (not illustrated) on the basis of the pressing force sensed by the pressure sensor 23. Accordingly, an appropriate pressing force, corresponding to the number of banknotes 2 stacked in the storage unit 14, is controlled to be applied to the pickup roller 15. As a result, the pickup roller 15 can appropriately convey only the lowermost banknote 2 among the plural banknotes 2 in the storage unit 14.

(Configuration of Separation Roller)

Figure 4:
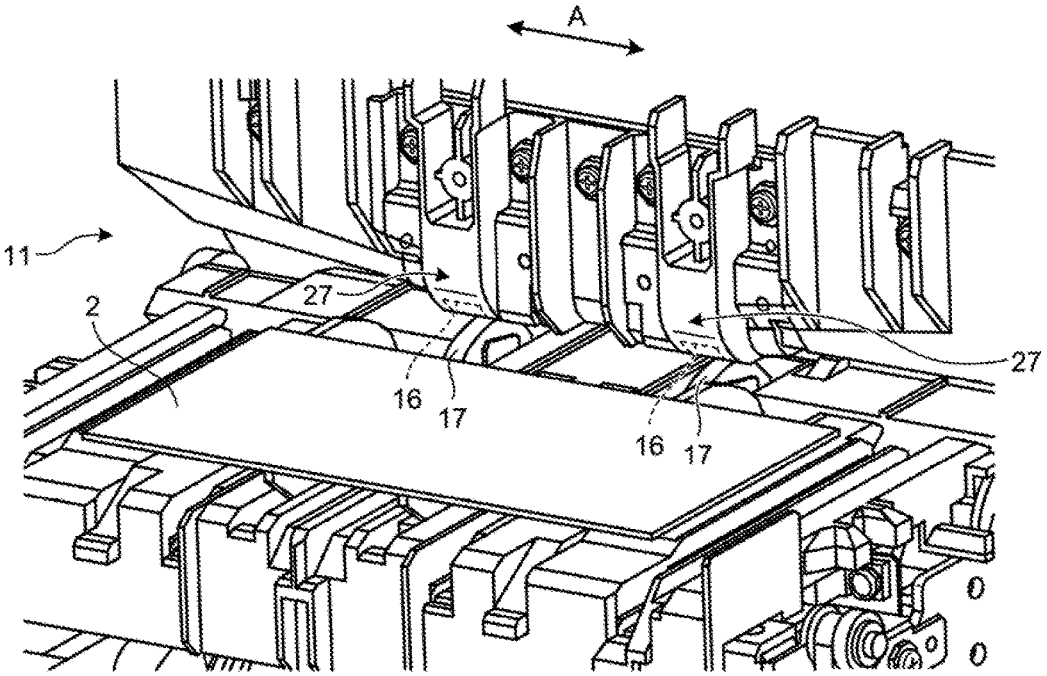
FIG. 4 is a perspective view illustrating a separation roller and a sending roller which are disposed in the banknote separating device according to the embodiment.
Figure 5:
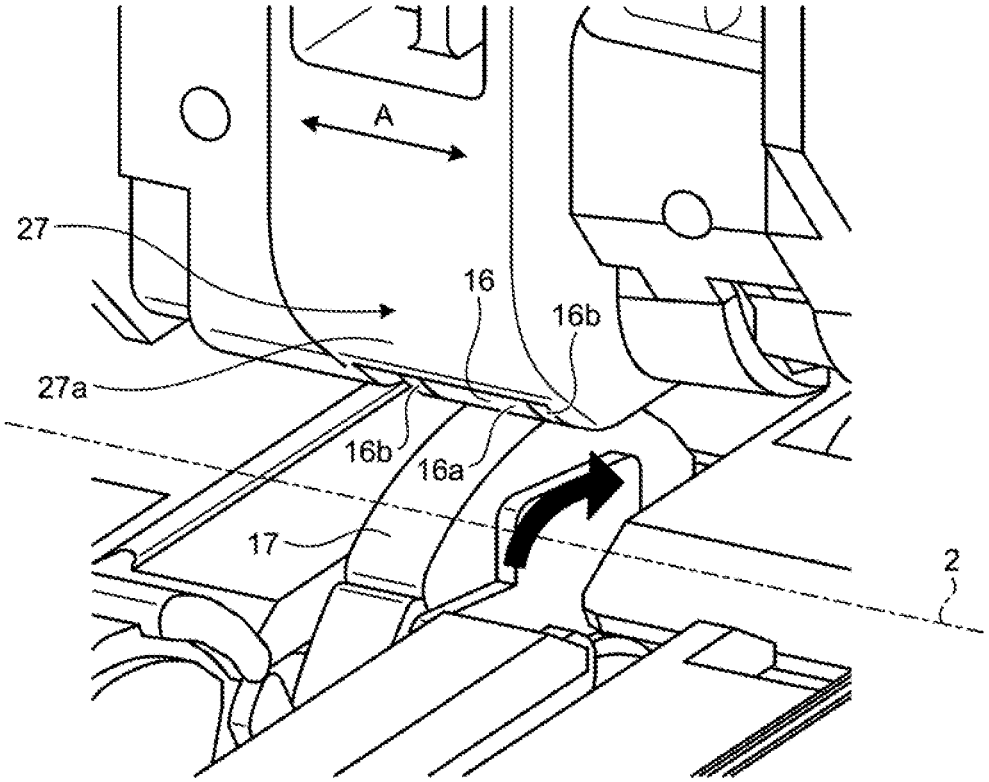
FIG. 5 is an enlarged perspective view illustrating the separation roller and the sending roller which are disposed in the banknote separating device according to the embodiment.
Figure 6:
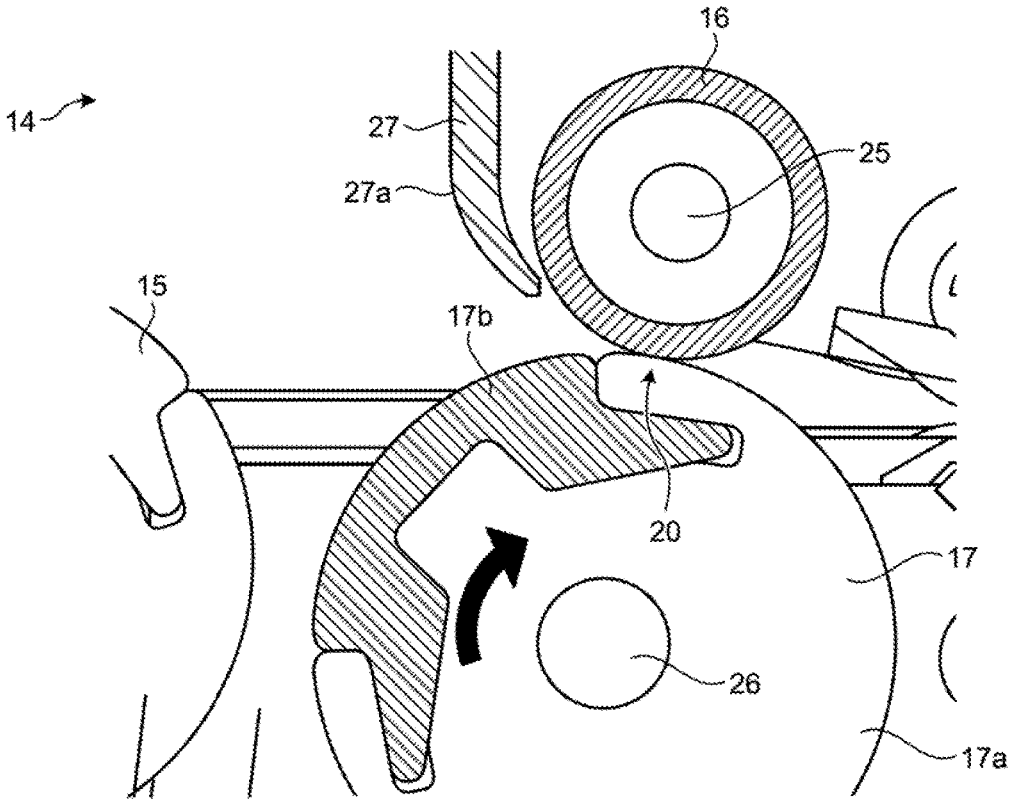
FIG. 6 is a cross-sectional view illustrating the separation roller and the sending roller which are disposed in the banknote separating device according to the embodiment.
Figure 7:
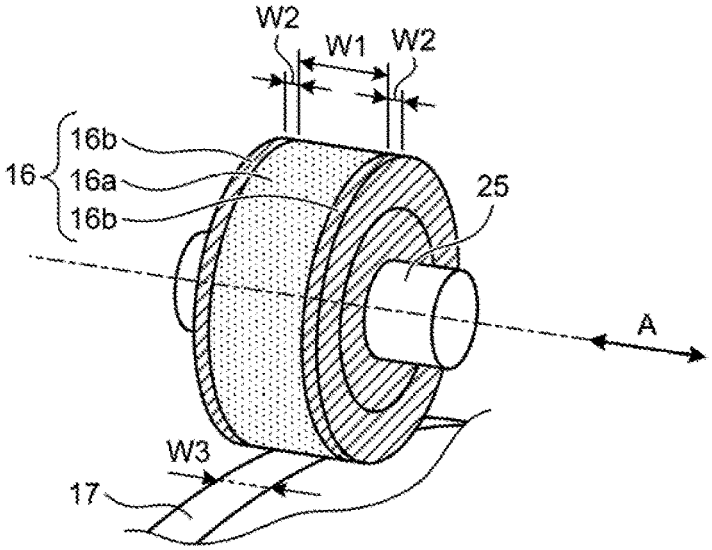
FIG. 7 is a perspective view illustrating the separation roller which is disposed in the banknote separating device according to the embodiment.

FIG. 4 is a perspective view illustrating the separation roller 16 and the sending roller 17 which are disposed in the banknote separating device 11 according to the embodiment. FIG. 5 is an enlarged perspective view illustrating the separation roller 16 and the sending roller 17 which are disposed in the banknote separating device 11 according to the embodiment. FIG. 6 is a cross-sectional view illustrating the separation roller 16 and the sending roller 17 which are disposed in the banknote separating device 11 according to the embodiment. FIG. 7 is a perspective view illustrating the separation roller 16 of the banknote separating device 11 according to the embodiment.

As illustrated in FIGS. 4 to 6, two sets of the separation roller 16 and the sending roller 17, are arranged with a predetermined gap in the long-side direction of a banknote 2 moving from the storage unit 14 side in the banknote separating device 11. One set of the separation roller 16 and the sending roller 17 includes the contact portion 20 in which the circumferential surfaces thereof contact each other. A banknote 2 stacked in the storage unit 14 storing banknotes 2 and sent from the storage unit 14, comes in contact with the separation roller 16. The sending roller 17 separates and conveys the banknotes 2 in the contact portion 20 with the separation roller 16 sheet by sheet, by rotating relative to the stopped separation roller 16.

The separation roller 16 is disposed above the sending roller 17 and is supported by a rotation shaft 25. The separation roller 16 does not rotate but stop at the time of separating and conveying the banknotes 2 in the storage unit 14. The separation roller 16 may be configured to rotate along with the sending roller 17 to follow the rotation of the sending roller 17 which reversely rotates in the direction, in which the banknote 2 is returned to the storage unit 14 side, when a jam occurs in the vicinity of the sending port 14*a*. In this case, the rotating state and the stopping state of the separation roller 16 are switched, for example, by a clutch mechanism.

The separation roller 16 is biased in a direction in which the separation roller comes in contact with the sending roller 17, by a biasing member such as a coil spring. Accordingly, the separation roller 16 is elastically displaced in a direction in which the separation roller 16 spaces apart from the sending roller 17 when the banknote 2 is sent through the contact portion 20. At this time, the separation roller 16 is set to form a gap corresponding to the thickness of one banknote 2 in the contact portion 20 with the sending roller 17.

As illustrated in FIGS. 5 and 6, a guide portion 27 for guiding a banknote 2, stacked in the storage unit 14, to the separation roller 16 side, is formed between the storage unit 14 and the separation roller 16. The guide portion 27 is formed of a resin material and extends from the inside of the storage unit 14 to the separation roller 16 side. As illustrated in FIG. 6, the guide portion 27 includes a curved surface 27*a*, which is curved such that an end portion on the separation roller 16 side comes close to the circumferential surface of the separation roller 16. Accordingly, a banknote 2, stacked in the storage unit 14, slides along the curved surface 27*a* of the guide portion 27 and is sent by the pickup roller 15, whereby the banknote smoothly moves to the separation roller 16 side.

As illustrated in FIG. 7, both end portions 16*b* in the axial direction A of the rotation shaft 25 of the separation roller 16, are formed of a material having a friction coefficient smaller than a friction coefficient of a central portion 16*a* in the axial direction A of the rotation shaft 25. In other words, the separation roller 16 in the embodiment includes the central portion 16*a*, which is a relatively high-friction portion, and the both end portions 16*b*, which are relatively low-friction portions. For example, the separation roller 16 includes the central portion 16*a* which is formed of a rubber material and the both end portions 16*b* which are formed of a resin material, in the axial direction A of the rotation shaft 25.

Figure 8:
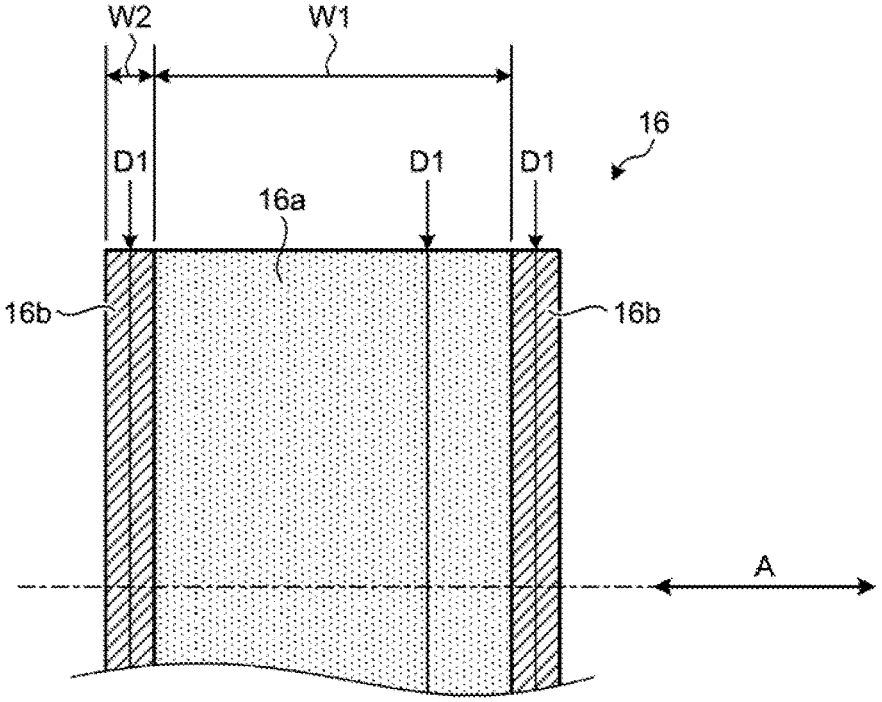
FIG. 8 is a side view illustrating a dimension of the separation roller which is disposed in the banknote separating device according to the embodiment.

FIG. 8 is a side view illustrating a dimension of the separation roller which is disposed in the banknote separating device according to the embodiment. The separation roller 16 has a cylindrical shape as a whole and the diameter D1 of the both end portions 16*b* is the same as the diameter D1 of the central portion 16*a* as illustrated in FIG. 8. That is, the separation roller 16 is formed in a cylindrical shape with a diameter of D1.

Regarding the diameters of the central portion 16*a* and the both end portions 16*b*, when the diameter of the central portion 16*a* formed of rubber is larger than the diameter of the both end portions 16*b* formed of resin, a banknote 2 and the both end portions 16*b* formed of resin do not come in contact with each other. Accordingly, as will be described later, the leading edge of the banknote 2 does not slide along the circumferential surface of the both end portions 16*b* and a jam prevention effect is not achieved. On the other hand, when the diameter of the both end portions 16*b* formed of resin is larger than the diameter of the central portion 16*a* formed of rubber, a banknote 2 and the central portion 16*a* formed of rubber do not come in contact with each other. Accordingly, the banknote 2 is not appropriately sent by the central portion 16*a* formed of rubber. Accordingly, this embodiment has a technical meaning, in that the diameter D1 of the central portion 16*a* and the diameter D1 of the both end portions 16*b* are the same.

In the separation roller 16 of the embodiment, only the outer circumferential part of the central portion 16*a* is formed of a rubber material, and the inner circumferential part of the central portion 16*a* and the both end portions 16*b* are integrally formed of a resin material. As the rubber material forming the central portion 16*a* of the separation roller 16, a material having hardness higher than that of the rubber material forming the sending roller 17, is used. An example of the rubber material forming the sending roller 17 is urethane rubber. In this way, by forming the central portion 16*a* out of the rubber material having hardness higher than that of the sending roller 17, the circumferential surface of the separation roller 16 side is not reduced when the contact portion 20 with the sending roller 17 is abraded. Accordingly, when the contact portion 20 is abraded, the sending roller 17 is replaced and replacement of the separation roller 16 is suppressed. The both end portions 16*b* of the separation roller 16 are formed of a resin material. Examples of the resin material include POM (polyacetal), PPE (polyphenylene ether) and the like.

The material forming the both end portions 16*b* is not limited to the resin material, but may be formed of, for example, a metal material or ceramics as long as it is a material causing the friction coefficient to be smaller than that of the rubber material forming the central portion 16*a*.

The embodiment is not limited to the configuration in which the both end portions 16*b* are formed of a low-friction material. On the circumferential surface of the separation roller 16, for example, a coat of a low-friction material or a coating film or a plating film including low-friction particles may be formed to cause the friction coefficient of the circumferential surface of the both end portions 16*b* to be smaller than the friction coefficient of the circumferential surface of the central portion 16*a*.

As illustrated in FIGS. 7 and 8, in the separation roller 16, the width W1 in the axial direction A of the central portion 16*a* is set to be larger than the width W2 of each end portion 16*b*. Accordingly, the frictional force of the central portion 16*a* and slipperiness of the both end portions 16*b* act on the leading edge of the banknote 2, coming in contact with the separation roller 16, in cooperation at a ratio suitable for the separation operation. As illustrated in FIG. 7, the width W1 of the central portion 16*a* of the separation roller 16 is set to be larger than the width W3 of the sending roller 17 to be described later. In the contact portion 20, the circumferential surface of the sending roller 17 comes in contact with the central part in the axial direction A (the width direction) of the circumferential surface of the central portion 16*a*. In this way, the width W1 of the central portion 16*a* is set depending on the width W3 of the sending roller 17 such that the width W3 of the sending roller 17 is located in the range of the width W1. The width W2 of each end portion 16*b* is set to ensure predetermined rigidity.

In the separation roller 16 of the embodiment, the entire area of the circumferential surface facing the sending roller 17 is exposed to come in direct contact with a banknote 2, moving from the storage unit 14, on the storage unit 14 side with respect to the contact portion 20 in contact with the sending roller 17. That is, the separation roller 16 is not covered with the metal plate in the above-mentioned related art. Accordingly, the separation roller 16 can come in contact with the leading edge of a banknote 2, moving from the storage unit 14, in the area of the circumferential surface facing the circumferential surface of the sending roller 17 from the end portion on the storage unit 14 side to the contact portion 20.

The separation roller 16 can be molded by a two-color molding method using a mold by forming the both end portions 16*b* out of a resin material, and the central portion 16*a* and the both end portions 16*b* are integrally molded. Accordingly, it is possible to skip a process of assembling and bonding the central portion 16*a* and the both end portions 16*b*, and is possible to decrease the manufacturing cost of the separation roller 16.

As needed, the edges on the end face sides of the both end portions 16*b* of the separation roller 16 may be formed in a small arc cross-sectional shape, thereby further suppressing skewing of a banknote 2. In this case, the edges on the end face sides of the both end portions 16*b* of the separation roller 16 can be easily molded in an R surface without performing an R chamfering process.

The sending roller 17 is disposed below the separation roller 16 and is supported by a rotation shaft 26. The sending roller 17 is connected to a driving mechanism that drives the pickup roller 15 and is rotationally driven with the rotation of the pickup roller 15. At this time, the separation roller 16 does not rotate but stops.

The sending roller 17 includes a base portion 17*a* which is formed of a resin material and an elastic portion 17*b* which is formed of a rubber material, and the elastic portion 17*b* is configured to be fitted onto the base portion 17*a*. Accordingly, as illustrated in FIG. 6, the elastic portion 17*b* is disposed in only a part in the circumferential direction of the sending roller 17. As the rubber material forming the elastic portion 17*b* of the sending roller 17, a material having a larger friction coefficient and lower hardness than the rubber material forming the central portion 16*a* of the separation roller 16, is used. For example, silicone rubber is used as the rubber material forming the elastic portion 17*b* of the sending roller 17. The silicone rubber is a material having a larger adhesive force and a larger frictional force than the urethane rubber, forming the central portion 16*a* of the separation roller 16. The diameter of the sending roller 17 is set to be larger than the diameter D1 of the separation roller 16 as a whole.

The rotational driving of the sending roller 17 is controlled by the control unit, and a rotation phase (a rotation angle) thereof is controlled such that the separation roller 16 comes in contact with the elastic portion 17*b* in the contact portion 20.

As illustrated in FIG. 3, an optical sensor 28 that counts the number of banknotes 2 passing through the contact portion 20 and senses skewing of a banknote 2, is disposed downstream side in the conveyance direction of a banknote 2 from the contact portion 20. The optical sensor 28 includes a light emitting portion 28*a* that emits detection light, and a light receiving portion 28*b* that receives the detection light emitted from the light emitting portion 28*a*. The light emitting portion 28*a* and the light receiving portion 28*b* are disposed to face each other with the conveyance passage of a banknote 2 interposed therebetween such that the detection light intersects a banknote 2 passing through the contact portion 20. The light emitting portion 28*a* and the light receiving portion 28*b* are electrically connected to the control unit, and a detection signal is transmitted from the light receiving portion 28*b* to the control unit. The control unit counts the number of banknotes 2 sent from the inside of the storage unit 14 and senses skewing of a banknote 2 on the basis of the detection signal.

In the storage cassette 13, a group of conveyance rollers 29 is rotatably disposed downstream side from the contact portion 20 in the conveyance direction of a banknote 2 sent from the storage unit 14. The conveyance rollers 29 are disposed to come in contact with the circumferential surface of the sending roller 17, and rotate with the rotation of the sending roller 17 to follow the rotation of the sending roller 17. The conveyance rollers 29 convey a banknote 2 to the outside of the banknote separating device 11, by conveying the banknote 2 with the banknote 2 interposed between the sending roller 17 and the conveyance rollers 29. A switching member 30 that switches the conveyance passage of a banknote 2, is pivotably disposed in the vicinity of the conveyance roller 29, disposed adjacent to the outside of the storage cassette 13.

In the embodiment, plural banknotes 2, stacked in the storage unit 14, are pressed downward in the vertical direction and the separation roller 16 is disposed above the sending roller 17, but the embodiment is not limited to this vertical configuration. For example, the separation roller 16 may be disposed below the sending roller 17, or the separation roller 16 and the sending roller 17 may be arranged in the horizontal direction.

(Separating Operation of Banknote Separating Device)

Figure 9:
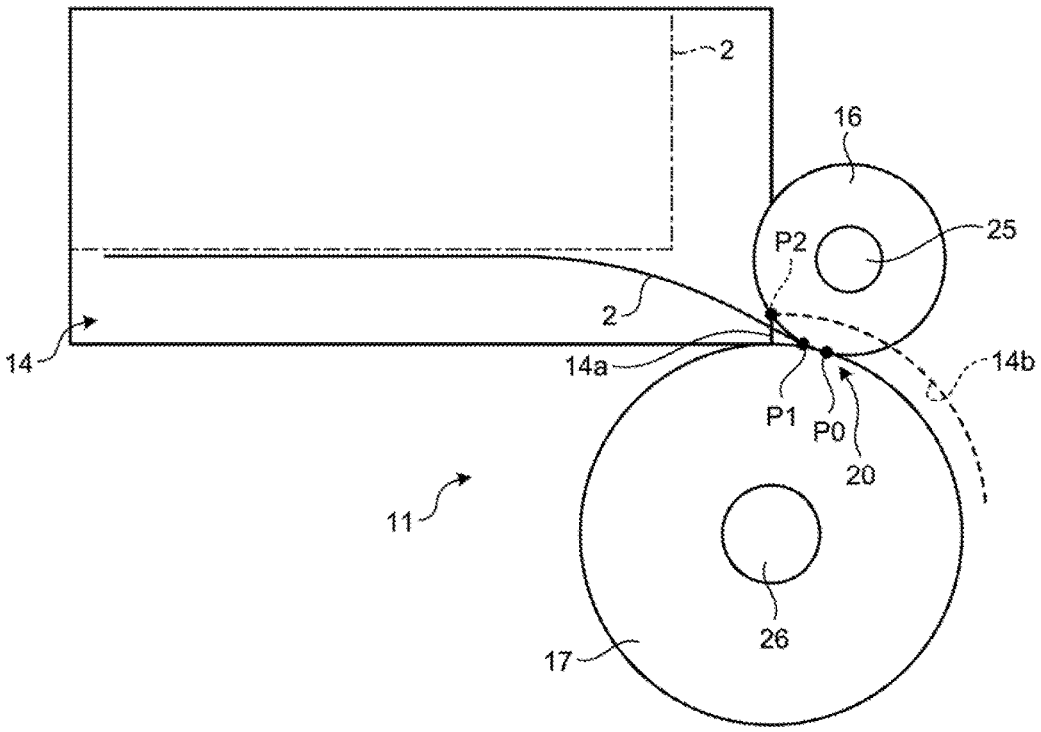
FIG. 9 is a schematic diagram illustrating an operation of conveying a banknote using the separation roller and the sending roller in the banknote separating device according to the embodiment.
Figure 10:
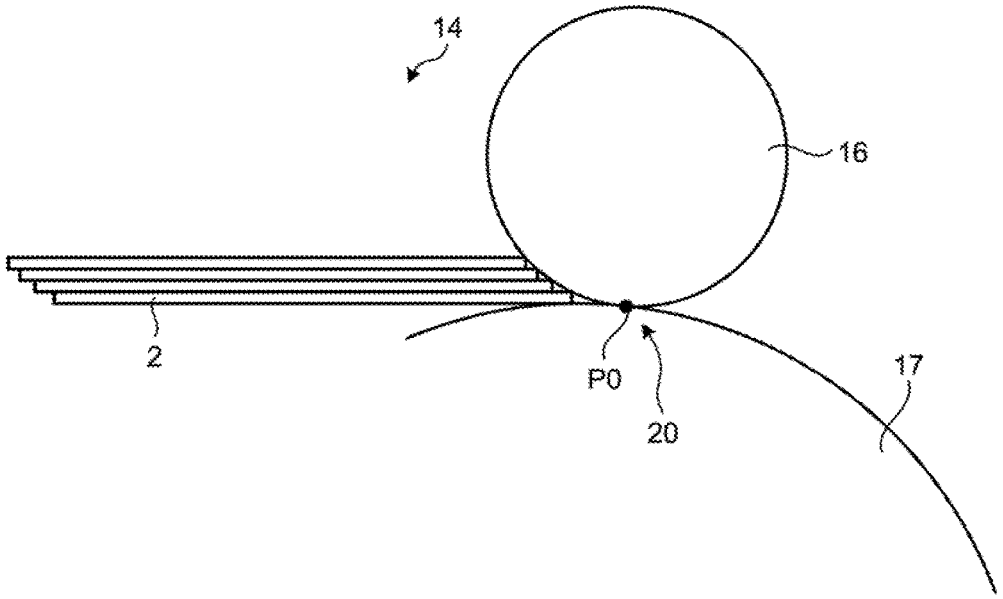
FIG. 10 is a schematic diagram illustrating a state in which a banknote is sent to the separation roller in the banknote separating device according to the embodiment.
Figure 11:
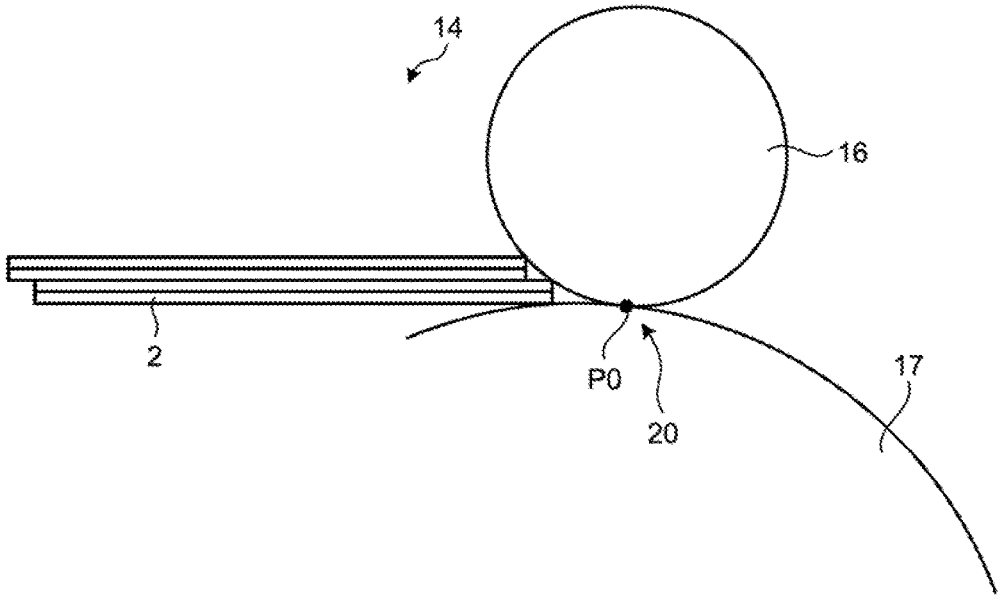
FIG. 11 is a schematic diagram illustrating a state in which banknotes are overlapped and sent to the separation roller in the banknote separating device according to the embodiment.
Figure 12:
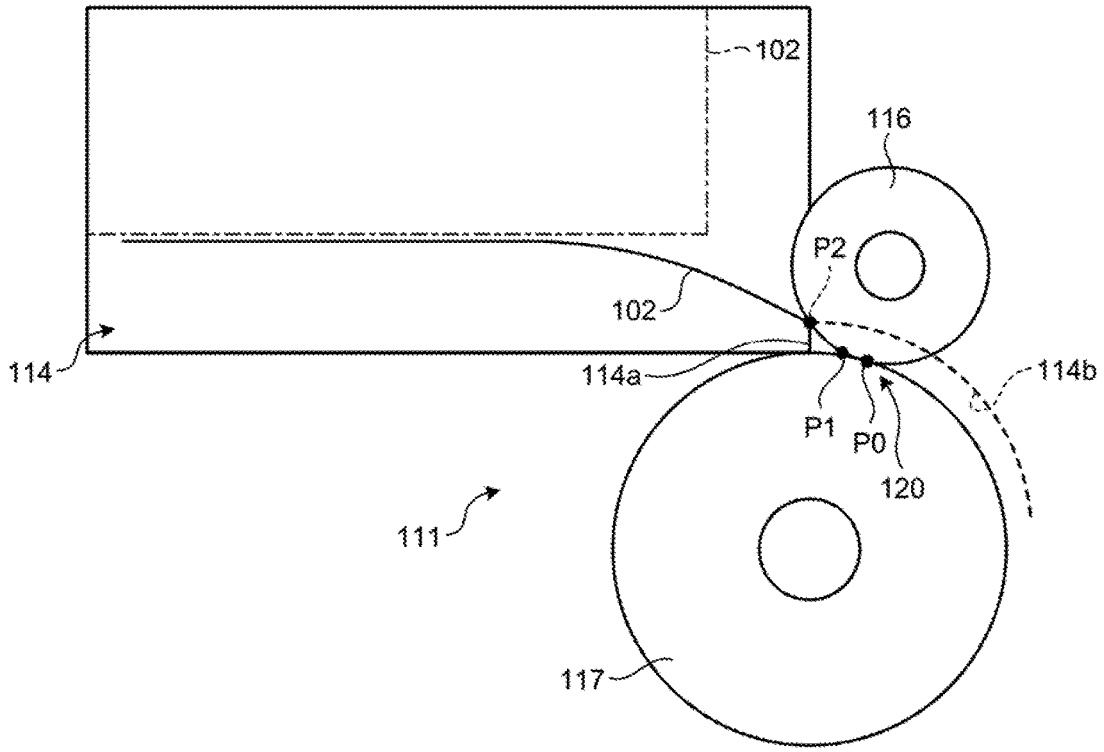
FIG. 12 is a schematic diagram illustrating an operation of conveying a banknote using a separation roller and a sending roller in a conventional banknote separating device.
Figure 13:
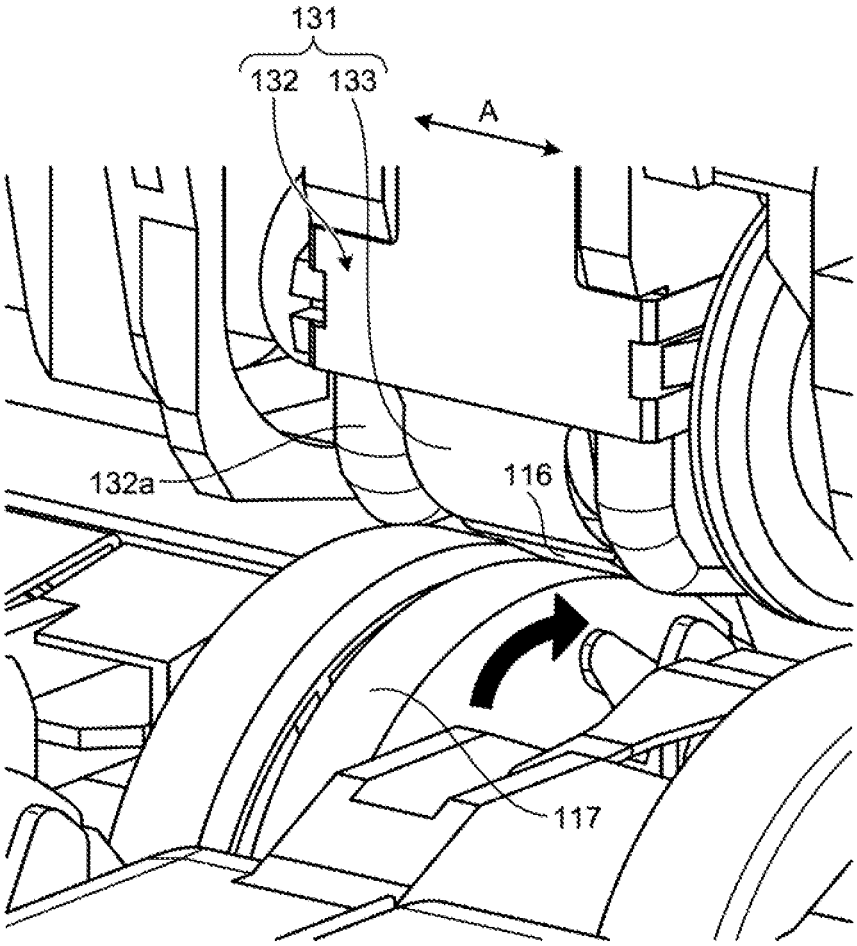
FIG. 13 is a perspective view illustrating a metal plate of a roller cover which is disposed in a banknote separating device according to the related art.
Figure 14:
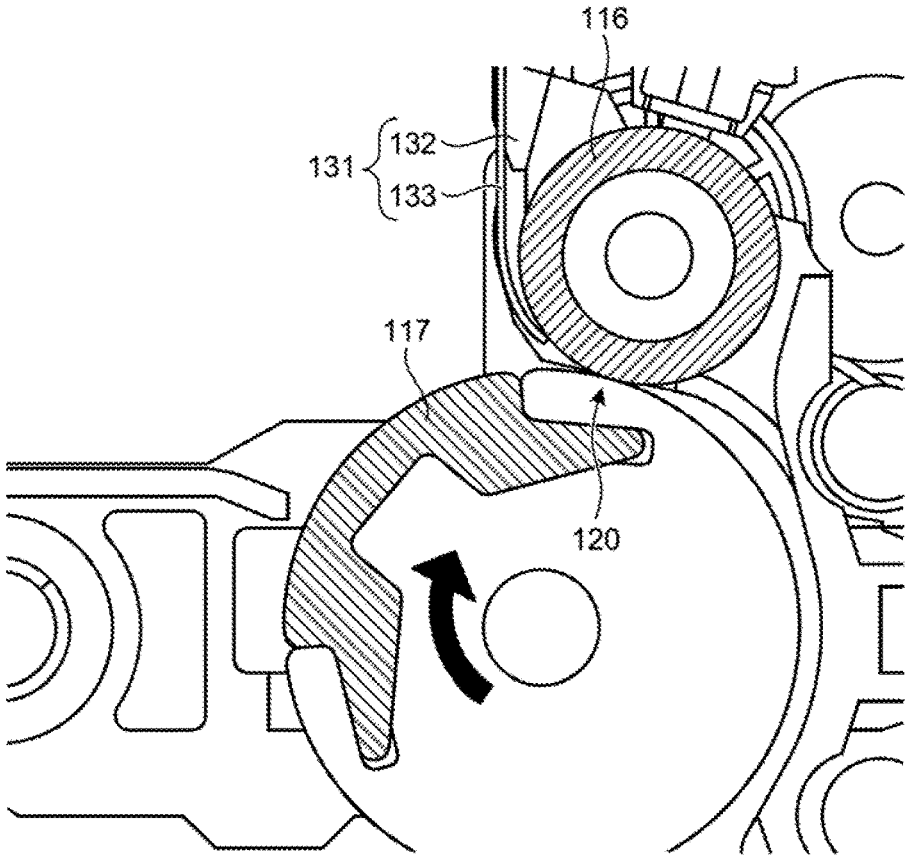
FIG. 14 is a cross-sectional view illustrating the metal plate of the roller cover which is disposed in the banknote separating device according to the related art.
Figure 15:
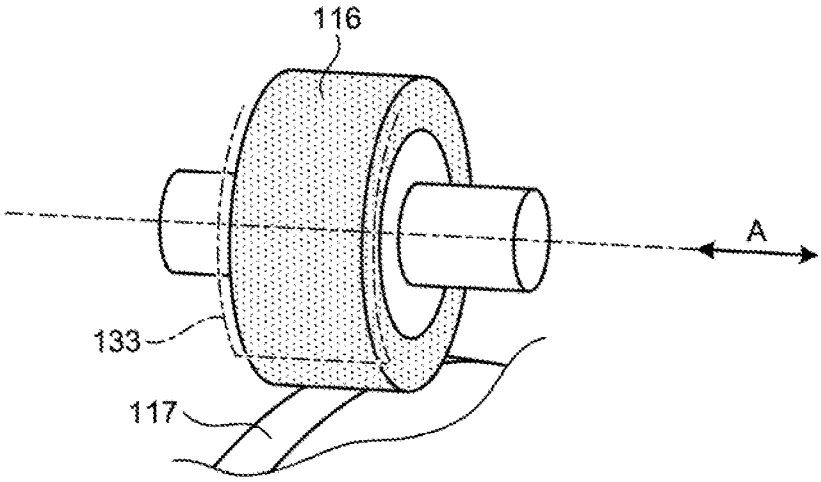
FIG. 15 is a perspective view illustrating the separation roller and the metal plate which are disposed in the banknote separating device according to the related art.
Figure 16:
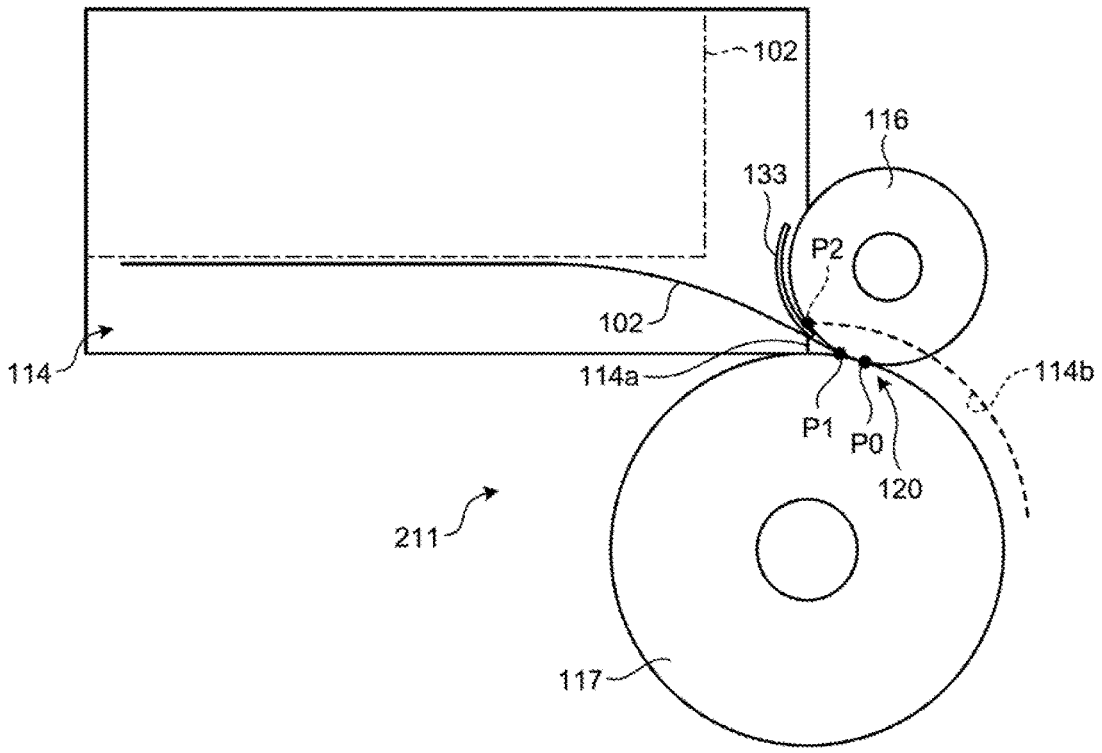
FIG. 16 is a schematic diagram illustrating an operation of conveying a banknote using the separation roller and the sending roller in the banknote separating device according to the related art.

An operation of separating banknotes 2 using the separation roller 16 and the sending roller 17 in the banknote separating device 11 according to the embodiment, will be described below. FIG. 9 is a schematic diagram illustrating the operation of conveying a banknote 2 using the separation roller 16 and the sending roller 17 in the banknote separating device 11 according to the embodiment. FIG. 10 is a schematic diagram illustrating a state in which a banknote 2 is sent to the separation roller 16 in the banknote separating device 11 according to the embodiment. FIG. 11 is a schematic diagram illustrating a state in which banknotes 2 are overlapped and sent to the separation roller 16 in the banknote separating device 11 according to the embodiment.

Here, a magnitude relationship of the frictional forces (contact resistance values) generated among a banknote 2, the separation roller 16, and the sending roller 17, will be described. In the embodiment, the frictional force betweeen a banknote 2 and the sending roller 17 is defined as F1, the frictional force between a banknote 2 and the central portion 16*a* of the separation roller 16 is defined as F2, the frictional force between a banknote 2 and the both end portions 16*b* of the separation roller 16 is defined as F3, and the frictional force between overlapping banknotes 2 is defined as F4. Here, the frictional forces F1 to F4 in the banknote separating device 11 satisfy a relationship of F1>F2>F4>F3. Since this relationship is satisfied, banknotes 2 can be appropriately separated and conveyed.

In the banknote separating device 11, plural banknotes 2 stacked in the storage unit 14 are pressed to the side of the pickup roller 15 which comes in contact with the lowermost banknote 2, by the stage 13*a*. As illustrated in FIGS. 9 and 10, two or more banknotes 2 including the lowermost banknote 2 among the banknotes 2 stacked in the storage unit 14 are sent to the separation roller 16 side, by the pickup roller 15. The two or more banknotes 2, sent by the pickup roller 15, moves along the curved surface 27*a* of the guide portion 27. Subsequently, the two or more banknotes 2 are sent along the conveyance passage 14*b* from the sending port 14*a* of the storage unit 14 and moves to the separation roller 16. At this time, the two or more banknotes 2, sent from the sending port 14*a* to the separation roller 16, are sent in a state, in which the banknotes are shifted in positions and overlapped in a step shape, in the direction in which the banknotes get close to the separation roller 16, as illustrated in FIG. 10.

The leading edge of the lowermost banknote 2 comes in contact with the circumferential surface of two separation rollers 16 which are arranged spaced apart in the length direction of the banknote 2. At this time, the leading edges of the banknotes 2 come in contact with the circumferential surface of the central portion 16*a* of each separation roller 16 and the circumferential surfaces of the both end portions 16*b*. The banknotes 2, coming in contact with the circumferential surfaces of the separation rollers 16, are sent to the contact portion 20, by the frictional force between the overlapped banknotes 2. At this time, the banknotes 2, coming in contact with the circumferential surfaces of the separation rollers 16, slide along the circumferential surfaces of the both end portions 16*b*, because the friction coefficient of the both end portions 16*b* is smaller than the friction coefficient of the central portion 16*a*. In this way, in the separation rollers 16 according to the embodiment, the leading edges of the banknotes 2 are guided to the contact portion 20 without applying a large frictional force to the leading edges of the banknotes 2, in cooperation of the circumferential surface of the central portion 16*a* with the circumferential surfaces of the both end portions 16*b*.

The banknotes 2, guided to the contact portion 20, are conveyed through the contact portion 20 by causing the sending roller 17 to rotate relative to the stopped separation roller 16, and are sent to the outside of the banknote separating device 11 through the conveyance passage. In this way, by causing the sending roller 17, having a relatively large frictional force, to rotate relative to the separation roller 16 of which the central portion 16*a* has a relatively small frictional force, only the lowermost banknote 2 of the overlapped banknotes 2 is separated and conveyed by the difference in the frictional force between the separation roller 16 and the sending roller 17. Accordingly, the banknotes 2, sent to the separation roller 16, are separated and conveyed sheet by sheet at the contact point P0 of the contact portion 20.

Accordingly, in the embodiment, as illustrated in FIG. 9, the leading edge of a banknote 2, moving from the storage unit 14, may come in contact with the contact point P2 close to the storage unit 14 side with respect to the circumferential surface of the separation roller 16. However, in this case, the contact point, between the leading edge of the banknote 2 and the separation roller 16, smoothly slides along the circumferential surfaces of the both end portions 16*b* of the separation roller 16. Accordingly, the leading edge of the banknote 2, coming in contact with the separation roller 16 at the contact point P2, smoothly moves to the contact point P1 along the circumferential surface of the separation roller 16 without stopping by the frictional force with the separation roller 16, and are guided to the contact point P0 of the contact portion 20.

Accordingly, even when the leading edge of the banknote 2 comes in contact with the separation roller 16 at any position in the area from the storage unit 14 to the contact point P0 of the contact portion 20 on the circumferential surface of the separation roller 16, the leading edge of the banknote 2 is smoothly guided to the contact portion 20 along the both end portions 16*b*. That is, the contact point, between the leading edges of the banknote 2 and the circumferential surface of the separation roller 16, is smoothly shifted to the contact point P0 of the contact portion 20. Accordingly, the banknotes 2, stacked in the storage unit 14, reach the contact portion 20 sheet by sheet and are appropriately separated and conveyed sheet by sheet, by the separation roller 16 and the sending roller 17.

The frictional force of the edge of the both end portions 16*b* of the separation roller 16 is also small. Accordingly, even when the leading edge of a banknote 2 comes in contact with the edge, the banknote 2 is prevented from skewing due to the frictional force with the edge, and occurrence of a jam is prevented.

As illustrated in FIG. 11, two or more banknotes 2, sent from the storage unit 14 to the separation roller 16, may be conveyed in an overlap feeding state in which all the banknotes 2 are overlapped. When this overlap feeding occurs, the frictional force F2, between the banknote 2 and the central portion 16*a* of the separation roller 16, is larger than the frictional force F4 between the overlapped banknotes 2, and thus the two or more banknotes 2 are sent to the contact portion 20 sheet by sheet.

In the embodiment, the operation of separating the banknotes 2 using the separation roller 16, corresponds to an operation after the leading edges of the banknotes 2 sent by the pickup roller 15 come in contact with the circumferential surface of the central portion 16*a* of the separation roller 16. After the leading edges of the banknotes 2 come in contact with the separation roller 16, the leading edge of one banknote 2 is sent to the contact portion 20 by the frictional force between the overlapped banknotes 2. The operation of separating the banknotes 2 using the separation roller 16, refers to an operation of separating and conveying the banknotes 2 sent to the contact portion 20 as described above from the contact portion 20 sheet by sheet by causing the sending roller 17 to rotate relative to the stopped separation roller 16. When only one banknote 2 is stored in the storage unit 14, the banknote 2 not stacked is sent by the separation roller 16. In the embodiment, the operation of separating the banknotes 2, stacked in the storage unit 14 sheet by sheet using the separation roller 16, includes such an operation.

(Banknote Separating Method Using Banknote Separating Device)

A banknote separating method according to the embodiment includes a first step of sending banknotes 2 stacked in the storage unit 14 to the separation roller 16, and a second step of separating and conveying the banknotes 2 sheet by sheet by using the sending roller 17 which rotates relative to the stopped separation roller 16 with the banknotes 2 inserted into the contact portion 20 in contact with the separation roller 16. The separation roller 16 used in the second step, is configured such that the entire area of the circumferential surface of the separation roller 16 facing the sending roller 17, is exposed to come in direct contact with the banknotes 2 moving from the storage unit 14 on the storage unit 14 side with respect to the contact portion 20 in contact with the sending roller 17. The separation roller 16 used in the second step, is configured such that the both end portions 16*b* in the axial direction A of the separation roller 16, are formed of a material having a friction coefficient smaller than that of the central portion 16*a* thereof, and the diameter D1 of the both end portions 16*b* is the same as the diameter D1 of the central portion 16*a*.

(Effects of Embodiment)

The banknote separating device 11 according to the embodiment includes the separation roller 16 in which the both end portions 16*b* in the axial direction A are formed of a material having a friction coefficient smaller than that of the central portion 16*a* and the diameter D1 of the both end portions 16*b* is the same as the diameter D1 of the central portion 16*a*. Accordingly, it is possible to appropriately separate banknotes 2 and to prevent skewing of the banknotes 2 or a jam of the banknotes 2. The entire area of the circumferential surface of the separation roller 16 facing the sending roller 17, is exposed to come in direct contact with banknotes 2, moving from the storage unit 14, on the storage unit 14 side with respect to the contact portion 20 in contact with the sending roller 17. That is, the area of the separation roller 16, from the storage unit 14 side to the vicinity of the contact portion 20, is not covered by the metal plate in the related art. Accordingly, when a jam occurs and a banknote 2 is reversely sent, the banknote 2 can be smoothly removed, and the jam can be easily resolved.

According to the embodiment, it is possible to secure reliability of the separating operation without using the metal plate 133 in the related art. Accordingly, it is possible to reduce the manufacturing cost of the banknote separating device 11, thereby enhancing productivity of the banknote separating device 11.

The separation roller 16 in the embodiment includes the central portion 16*a*, which is formed of a rubber material, and the both end portions 16*b*, which is formed of a resin material. By forming the both end portions 16*b* out of the resin material in this way, there is no need to perform the R chamfering process on the edges of the both end portions 16*b* and it is thus possible to reduce the processing cost of the separation roller 16.

By forming the separation roller 16 out of the rubber material and the resin material, it is possible to integrally mold the central portion 16*a* and the both end portions 16*b*, and is possible to further reduce the manufacturing cost of the separation roller 16.

In the separation roller 16 of the embodiment, the width W1 in the axial direction A of the central portion 16*a*, is larger than the width W2 of each of the both end portions 16*b*. Accordingly, the frictional force from the central portion 16*a* and the slipperiness from the both end portions 16*b*, can act on the leading edge of the banknote 2, coming in contact with the separation roller 16, in cooperation at a ratio suitable for the separating operation.

In the embodiment, the both end portions 16*b*, formed of the resin material, are formed over the entire circumference in the circumferential direction of the separation roller 16, but the embodiment is not limited to this configuration. For example, when the rotation phase of the separation roller 16 is configured to be controlled, a configuration, in which only a part in the circumferential direction of the both end portions 16*b* of the separation roller 16 is formed of the resin material, may be employed. In this case, the same effects as in the embodiment can be achieved.

The banknote separating device 11 according to the embodiment has been described above as an example in which the banknote separating device 11 is applied to the first temporary storage unit 4 of the above-mentioned banknote handling device 1, but the configuration using the banknote separating device 11 is not limited to the example. For example, the banknote separating device 11 according to the embodiment may be applied as a banknote separating device included in the return unit 7 (a recycle unit) of the banknote handling device 1. In this case, the same effects as in the embodiment can be achieved.

According to an aspect of the paper sheet separating device disclosed herein, it is possible to appropriately separate paper sheets and to prevent skewing of paper sheets or a jam of paper sheets.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A paper sheet separating device comprising:

a pickup roller which sends a paper sheet among paper sheets stacked and stored in a storage unit, a separation roller with which the paper sheet, sent from the storage unit by the pickup roller in a non-guiding feed state, comes in contact; and a sending roller that is disposed in contact with the separation roller and that separates and conveys the paper sheets sheet by sheet by rotating relative to the stopped separation roller, wherein an entire area of a circumferential surface of the separation roller facing the sending roller, is exposed to come in direct contact with the paper sheet, moving from the storage unit, on the storage unit side with respect to a contact portion which is in contact with the sending roller, the separation roller is disposed so that a leading edge of the paper sheet sent by the pickup roller is caused to be sent from the storage unit to a direction away from a thickness direction of the paper sheets in the non-guiding feed state, and to come in contact with the circumferential surface of the separation roller, and both end portions in an axial direction of the separation roller are formed of a material, having a friction coefficient smaller than a friction coefficient of a central portion in the axial direction of the separation roller, and the diameter of the both end portions is the same as the diameter of the central portion.

2. The paper sheet separating device according to claim 1, wherein the separation roller includes, in the axial direction, the central portion formed of a rubber material, and the both end portions formed of a resin material, each width of the both end portions in the axial direction of the separation roller being one-sevenths of a width of the central portion.

3. The paper sheet separating device according to claim 2, wherein the central portion and the both end portions of the separation roller are integrally molded.

4. A paper sheet separating method comprising:

sending paper sheets from the storage unit to a separation roller by a pickup roller in a non-guiding feed state; and separating and conveying the paper sheets sheet by sheet by a sending roller which rotates relative to the stopped separation roller with the paper sheet inserted into a contact portion in contact with the separation roller, wherein the separation roller used, in separating and conveying, is configured such that an entire area of a circumferential surface of the separation roller facing the sending roller is exposed to come in direct contact with the paper sheet moving from the storage unit on the storage unit side with respect to the contact portion, the separation roller is disposed so that a leading edge of the paper sheet sent by the pickup roller is caused to be sent from the storage unit to a direction away from a thickness direction of the paper sheets in the non-guiding feed state, and to come in contact with the circumferential surface of the separation roller, and both end portions in an axial direction of the separation roller are formed of a material, having a friction coefficient smaller than a friction coefficient of a central portion in the axial direction of the separation roller, and the diameter of the both end portions is the same as the diameter of the central portion.

* * * * *